United States Patent [19]

Buckner

[11] 4,092,976

[45] June 6, 1978

[54] AIR CONDITIONER

[75] Inventor: Carrol E. Buckner, Asheville, N.C.

[73] Assignee: Buck Stove Marketing, Corp., Asheville, N.C.

[21] Appl. No.: 693,805

[22] Filed: Jun. 7, 1976

[51] Int. Cl.[2] ..... F24C 1/14

[52] U.S. Cl. ..... 126/63; 126/6; 126/66; 126/121; 126/134; 126/202; 165/170

[58] Field of Search ..... 126/6, 61, 63, 66, 67, 126/121, 123, 131, 140, 134, 202; 237/51; 165/170

[56] References Cited

U.S. PATENT DOCUMENTS

| | | | |
|---|---|---|---|
| 141,771 | 8/1873 | Duerstock | 126/6 |
| 591,315 | 10/1897 | Wilson | 126/202 X |
| 1,470,542 | 10/1923 | Poling | 126/140 |
| 1,562,139 | 11/1925 | Berry | 126/121 |
| 1,640,937 | 8/1927 | Heinish | 126/121 |
| 1,722,560 | 7/1929 | Cornelius | 126/121 |
| 2,052,643 | 9/1936 | Modine | 126/121 |
| 2,627,914 | 2/1953 | Helwig | 126/202 X |
| 3,190,282 | 6/1965 | Bauer | 126/131 |

FOREIGN PATENT DOCUMENTS

| | | | |
|---|---|---|---|
| 617,901 | 4/1961 | Canada | 126/121 |
| 440,682 | 7/1912 | France | 126/121 |
| 18,077 of | 1909 | United Kingdom | 126/123 |
| 135,415 | 11/1919 | United Kingdom | 126/121 |

*Primary Examiner*—William F. O'Dea
*Assistant Examiner*—Harold Joyce
*Attorney, Agent, or Firm*—Leitner, Palan, Martin & Bernstein

[57] ABSTRACT

A free standing unit for modifying the temperature in a U-shaped forced air channel which has air directing baffles. The wall structure of the unit maximizes forced air temperature modification for heating or cooling sources and provides a cooking surface for a heat source.

19 Claims, 4 Drawing Figures

AIR CONDITIONER

BACKGROUND OF THE INVENTION

1. Field of the Invention

The present invention relates generally to air conditioning units and more specifically to a free standing air conditioning unit using forced air.

2. Description of the Prior Art

With the energy crisis a great concern, people have generally been preoccupied with maximizing the use of cheap and inexpensive fuels. A major effort has been to include heat collectors in fireplaces to collect the heat normally generated by the wood burning therein and to transmit it into the room more efficiently than that provided by the normally designed fireplace. A forced air system in combination with such heat collectors is shown in U.S. Pat. No. 3,896,785.

Even before the energy crisis, people were concerned with the loss of heat escaping through the flue of a heating source. U.S. Pat. Nos. 1,490,135 and 3,094,980 make use of the flue heat in a stove and fireplace respectively to heat a second column of forced air which is introduced into the room in which the stove or fireplace is located.

Prior art space heaters have also been used or converted to fireplaces to provide a pleasing and second mode of heating. An example of this is shown in U.S. Pat. No. 1,944,626.

Although showing many methods of recapture of heat loss by normal fireplace or space heaters, the prior art has not made the most effective use of the heating source. Similarly, the prior art had not recognized the ability of a properly designed heating unit to be used also as a cooling unit. It should be noted that the word "air conditioner" as used in the title of the invention, the description of the invention and the claims is to be any device which modifies the ambient temperature, be it by heating or cooling.

SUMMARY OF THE INVENTION

The present invention is an air conditioning device having double walled sides, back and bottom and a single walled front and top. The sides and back form a U-shaped air channel having baffles therein to direct the forced air from a fan in the back wall to a pair of vents in the front wall. The double walled bottom also has a baffle and vent system which is in communication with the U-shaped air channel. The baffles in the back wall portion of the air channel causes the forced air to diverge from the forced air source towards the side wall portion of the channels. The baffles in the side wall portion of the channels divide the forced air into three streams which converge on their respective vents. A pair of baffles are included between the front wall and the top and bottom walls respectively in the air channel to direct the air toward the vents. The top of the housing is made of a single piece of heat conducting material and provides a surface to cook on. The front wall includes an opening with a closure there-cross allowing access to the interior chamber wherein in a source of heat or cooling may be placed.

The closure includes a pair of sliding openings or valves which adjust the air intake into the internal chamber when a source of heat is provided in the air conditioning unit and are closed to seal the inner chamber when a source of cooling is used. The top includes an opening through which the exhaust of a source of heating is connected to a flue. A rim is provided on the front wall adjacent to the opening to receive a screen which is placed on a platform connected to a bottom of an air conditioning unit. The forced air system includes a fan and a source of humidity.

OBJECTS OF THE INVENTION

An object of the present invention is to provide an air conditioning unit which is capable of heating or cooling forced air.

Another object is to provide a unique forced air channel having a baffle system to maximize the air flow.

A further object of the invention is to provide an air conditioning unit which is capable of being used as a source of heat, a source of cooling, a cooking stove, and a fireplace.

Still another object of the invention is to provide an air conditioning unit which is free standing and safe to use in the home.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
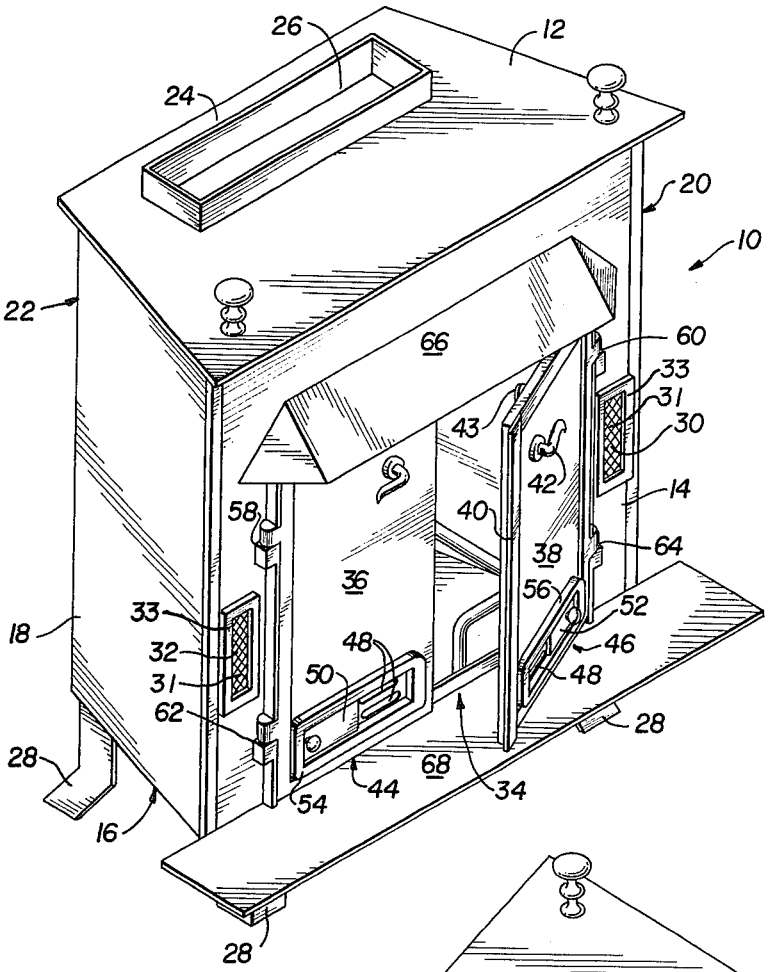
FIG. 1 is a front perspective view of an air conditioning unit employing the principles of the present invention.

FIG. 1, which illustrates a preferred embodiment of the air conditioning unit 10, shows a housing having top, front, bottom, two sides, and back walls 12, 14, 16, 18, 20, and 22 respectively. Top wall 12, which is a single walled portion of the housing, extends past the front, back, and side walls and includes a collar 24 surrounding an orifice 26. A flue (not shown) to remove the fumes from a source of heat or combustible material is connected to orifice 26 through the collar 24. The air conditioning unit 10 is supported by four legs 28 providing space between the floor and the bottom wall 16. Front wall 14 has a pair of vents 30 and 32 each covered by a screen 31 which is secured to the front wall 14 by a bracket or lip 33 extending substantially perpendicular from the face of the front wall 14 and extending across the vent opening. Also provided on the front wall is an opening 34 covered by a closure including a pair of doors 36 and 38. The door 38 has a strip 40 which overlaps door 36 and holds it in place when closed. Handle 42 on door 38 is connected to a latch 43 which engages the top interior portion above the opening 34 so as to lock the doors closed.

Also provided on doors 36 and 38 are a pair of valves 44 and 46. The sliding portions 50 and 52 of valves 44 and 46 slide within guide members 54 and 56 to adjust the size of a plurality of elongated openings 48 in doors 36 and 38. When a source of heat is provided in the interior chamber of housing 10, the slides 50 and 52 adjustably vary the valves 44 and 46 to regulate the amount of air or draft introduced into the chamber. For a wood burning source of combustible material, this would vary the rate of burning as well as the temperature. These valves are used in conjunction with an adjustable flue orifice 26. When a source of cooling is provided in the interior housing 10, the valves 44 and 46 are closed and a closure may be provided (not shown) for flue opening 26. This would substantially seal the interior chamber and prevent any escape of the energy from the cooling source except through the walls of the housing 10. A gasket may be provided between the front wall and the doors 36 and 38 to provide a better seal for a cooling source (for example, a block of ice). A baffle 57 (shown in FIG. 2) is provided at the rear top portion of the interior chamber to direct the fumes from a source of heat toward the orifice 26 and a flue connected thereto.

The doors 36 and 38 are mounted to the housing by upper hinges 58 and 60 and lower hinges 62 and 64 respectively. Also mounted to the front wall 14 is a hood 66 and a platform 68. The purpose of the hood 66 and the platform 68 will become clear in the description of FIG. 3 and the use of the air conditioning unit as a fireplace to be described later.

Figure 2:
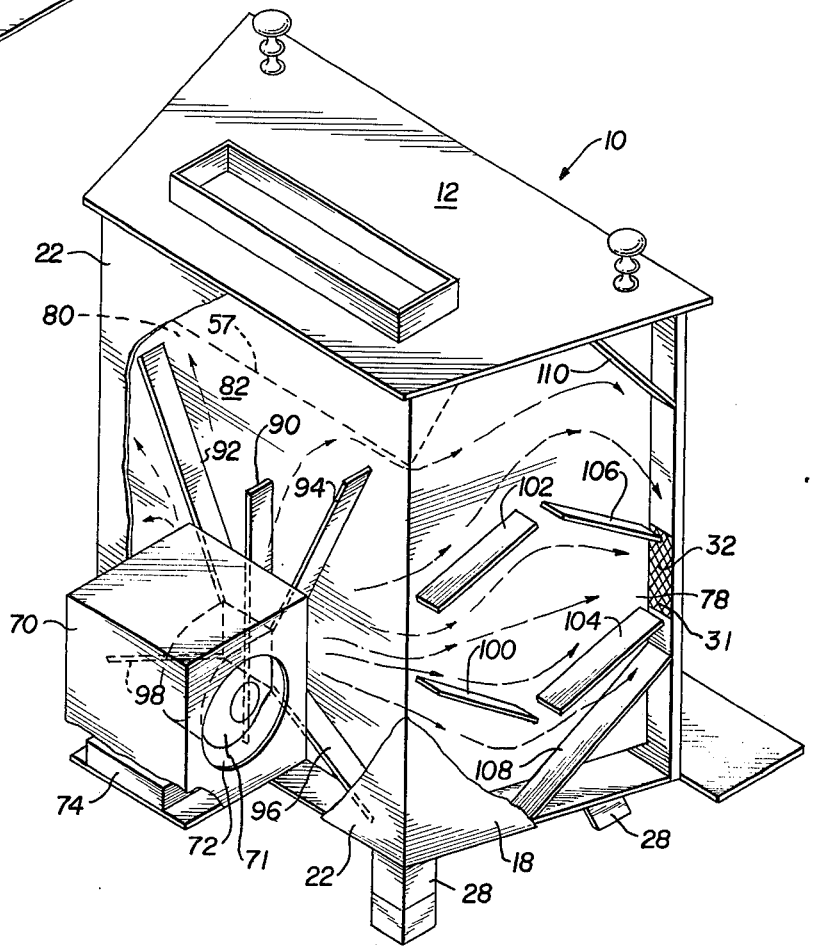
FIG. 2 is a rear cutaway perspective of an air conditioning unit illustrating the baffle system.
Figure 3:
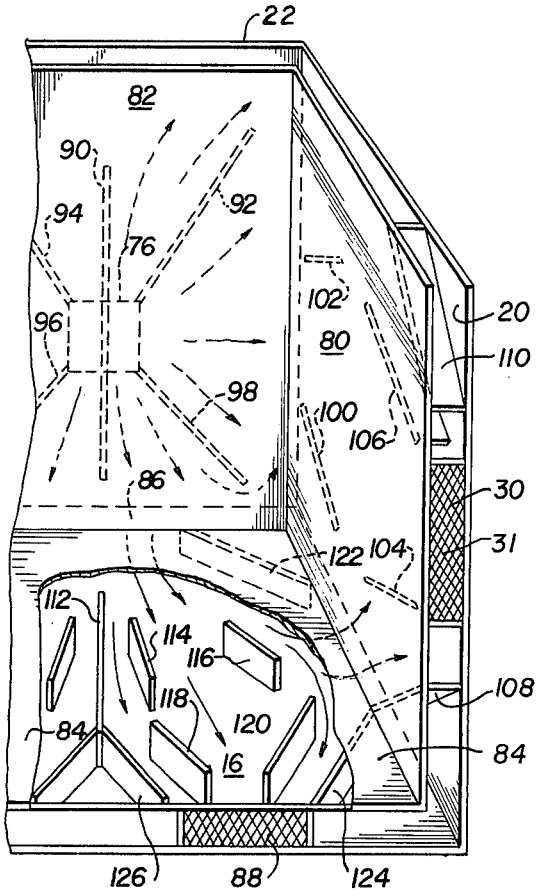
FIG. 3 is a front partial perspective of the bottom, back, and side walls of an air conditioning unit illustrating the baffle system.

The forced air system including a source of forced air, a channel, and baffle system are illustrated specifically in FIGS. 2 and 3. The source of forced air, including a housing 70, is mounted to the back wall 22 and includes an opening 72. Located within the housing 70 is a fan 71 or any other system which will receive air through opening 72 and provide a forced air flow within the channels to be described. Also contained within housing 70 may be a source of moisture which is illustrated, for example, as a pan 74 having water therein. The pan of water, if desired, is illustrated as merely one example of a source of moisture. Forced air housing 70 communicates with the forced air channels via an opening 76 in the back wall 22.

The air channel of the present device includes the exterior sides, back, and bottom walls 18, 20, 22, and 16 respectively and interior sides, back, and bottom walls 78, 80, 82, and 84 respectively. The sides and back walls of the housing and the sides and back interior walls form a generally U-shaped forced air channel with the side walls at an angle other than 90 degrees relative to the back and front walls where the forced air from opening 76 is transmitted towards front vents 30 and 32. The forced air from opening 76 is also provided through an opening 86 into the forced air channel formed by the housing and the interior bottom walls. Forced air from opening 76 is provided through opening 86 into the bottom forced air channel to exit through a pair of vents 88, illustrated in FIG. 3, in the front portion of the bottom air channel. Thus it can be seen that forced air traverses substantially all the surface of the interior back, side and bottom walls.

Interior to both air channels are a baffle system to create specific air patterns which diverge from the forced air source at opening 76 and converge on the respective vents in the front of the air conditioning unit 10. The rear wall portion of the baffle system includes a vertical baffle 90 substantially bisecting opening 76 from the forced air system. Also provided in the rear wall are two upper baffles 92 and 94 and two lower baffles 96 and 98 which diverge from the forced air opening 76. Baffles 94 and 96 cause divergent air flow towards one side wall channel while baffle 92 and 98 in combination provide diverging air flow toward the other wall channel. The upper portion of baffle 90 in combination with baffles 92 and 94 direct an upward flow towards the respective side wall channel portions. The lower portion of vertical baffle 90 in combination with lower baffles 96 and 98 provide a flow towards opening 86 into the bottom forced air channel as well as providing a small flow to the respective side forced air channel.

Located in the side forced air channels are additional baffles 100, 102, 104, 106, 108, and 110. The baffles 100, 102 divide the air flow from the rear forced air channel into three air channels. The baffles 104, 106, 108, and 110 redirect the three streams of air to converge on the respective vents 32 as illustrated in FIG. 2 and 30 as illustrated in FIG. 3. The baffles 108 and 110 are shown as extending from the bottom and top walls of the housing to the front wall adjacent the vent. The baffle system in the side walls produce streams of air which are not troubled by eddy currents, dead air pockets, localized hot spots and other disadvantageous features of the prior art systems. Similarly, the specific design of the baffles and their location increase the length of the path the air travels and thereby allows a greater heat transfer from the interior of the air conditioning unit to the forced air without sacrificing the head of the air emitting from the vents 30 and 32. Prior art devices generally substantially increase the length of the air path while sacrificing the head of the air at the vents and thereby super heating the air and reducing the heat transfer ability of the interior walls.

The bottom air channel formed by walls 16 and 84 include a center baffle 112, dividing the bottom into two chambers, and baffles 114, 116, 118, 120, 122, 124, 126 directing the air flow diverging from the entrance at opening 86 and converging on the vents 88. The theory of operation and design of the baffle system for the bottom channel is similar to that created for the side forced air channels. The forced air in the bottom channel also flows into the sides of the U-shaped forced air channel. Baffles 122 and 116 of the bottom forced air channel direct forced air toward baffles 104 and 108 of the side forced air channel in addition to the flow towards baffles 120 and 124 of the bottom forced air channel. Since the source of temperature modification is generally placed on interior bottom wall 84, the communication of the air flow from the bottom forced air channel to the side forced air channel increases the efficiency of the temperature transfer.

From reviewing FIGS. 1 through 3, it is evident that the sides, back, and bottom walls are double walled and the top and front walls are single walls. This specific choice of design is selected so that the exterior walls 18, 20, 22, are closer to the ambient temperature than the temperature of the top and front walls 12 and 14. When a source of heat is provided interior to the air conditioning unit 10, the top wall 12 is hot enough to cook whereas the side walls are of substantially lower temperature which reduces the probability of burns due to contact with the side walls. This effect is produced by the double wall concept wherein the forced air acts as a source of insulation for the outer, side and back walls by cooling the interior and exterior walls of the channel.

Preferred method of assembly of the present air conditioning unit is to form the exterior side and back walls 18, 20, and 22 out of a single piece of material and the interior side and back walls 78, 80, and 82 also out of a single piece of material. The baffles are mounted to the exterior side and back walls and the interior side and back walls are mounted to the baffles preferably by welding. The bottom exterior wall 16 is welded to the exterior side and back walls 18, 20, 22 and the baffles of the bottom forced air chamber are mounted to the bottom exterior wall. The bottom interior wall 84 is then joined to interior side and back walls 78, 80, 82. The top and front walls are then mounted to the structure by welding. The welding bead formed between the top and the side and back walls provides a thermal barrier or guard such that the portion of the top 12 which extends beyond the side and back walls is cooler than a portion of the top which is directly over the interior chamber when the chamber includes a source of heat. The remaining elements are attached or mounted to the front wall and the forced air unit mounted to the rear wall. It is suggested that the interior side and back walls 78, 80, and 82 be made of 3/16 inch thick steel and the exterior side and back walls as well as the top and front walls be made of ⅛ inch thick steel. The bottom exterior and interior walls may be made of 3/16 inch steel. The selection of different thicknesses of steel provides for a maximun absorption of the heating or cooling of the interior chamber as a heat exchanger to be used in contact with the forced air which cools the interior walls while taking advantage economically of thinner exterior walls.

Figure 4:
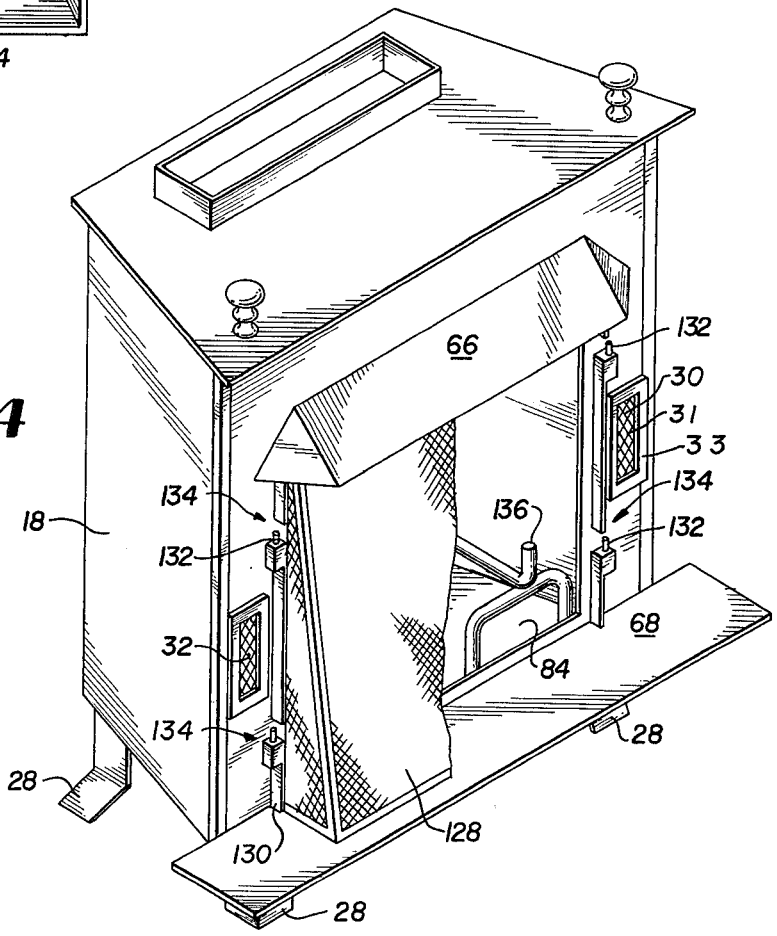
FIG. 4 is a front perspective of a fireplace employing the principles of the present invention.

The air conditioning unit 10, as illustrated in FIG. 4, may be used as a free standing fireplace. The closures 36 and 38 are removed and a screen 128 is provided underneath hood 66 and resting on platform 68. The screen is a typical fireplace screen to prevent sparks and ashes from emitting from the fireplace and causing a fire hazard within the room. Adjacent to and surrounding openings 34 is a rim 130. Four pins 132 of hinges 58, 60, 62, 64 are provided on the rim 130 as well as four openings 134 in the rim. The matching hinge element of the closures 36, 38 move in and out of the openings 134 in the rim 130. In addition to providing the pin portion 132 of the hinges for the closures 36 and 38, the rim 130 provides a guide and retainer for the screen 128 which fits within the rim 130. Though not shown, the rim 130 extends above and across the top of the opening 34. A pair of andirons 136 are provided in the interior chamber to support the source of temperature modification. It should be noted that grating or other supports may be used instead of andirons 136. Similarly a source of coolant may be placed directly on the bottom wall 84.

From the preceding description of the preferred embodiments, it is evident that the objects of the invention are obtained. The air conditioning unit 10 provides a four double walled housing having forced air channels including a baffle system therein and two single walls of the housing providing for transfer of a heating and cooling source to the exterior of the housing. The air conditioning unit may be used with a source of heat or cooling and when used with a source of heat may be a stove or a cooking range or a fireplace. Although the invention has been described and illustrated in detail, it is to be clearly understood that the same is by way of illustration and example only and is not be be taken by way of limitation. The spirit and scope of this invention being limited only by terms of the appended claims.

What is claimed:

1. An air conditioning unit comprising:

a housing having a top, a bottom, a front, a back, and two side walls;

a back and two side interior walls adjacent to said back and two side walls of said housing for forming a substantially U-shaped forced air channel;

an opening in said front wall for providing access to a chamber defined by the interior of said interior walls;

vent means in a front wall of said side air channels adjacent the side edges of said opening;

a rim mounted to said front wall of each of said side air channels and extending across said vent means from the outer lateral edge thereof;

the side exterior walls of said forced air channel forming an angle less than ninety degrees with the front wall of said side forced air channels;

means mounted to said housing for forcibly introducing air into the back portion of said channel through a port to traverse said air channel and to exit said vent means creating an exiting forced air pattern adjacent said side edges of said opening; and directing means interior said air channel for directing said forced air from said port over a substantial portion of said back and two side interior walls to said vent means.

2. The air conditioner of claim 1 wherein said directing means includes, for each vent means, a pair of a baffles extending from the front of said channel adjacent said vent means rearwardly to the top and bottom of said channel respectively.

3. The air conditioner of claim 2 wherein said directing means further includes between said housing and each pair of interior side walls elements for dividing said forced air into three streams converging at said vent means.

4. The air conditioner of claim 3 wherein said directing means further includes two pair of baffles between said housing and interior rear walls, each pair causing said air from said forced air means to diverge from said port as it is forced toward said side walls.

5. The air conditioner of claim 2 wherein said top wall includes an orifice connected to a flue, said front wall includes a closure across said opening and said closure includes an adjustable valve means which is closed when a source of cooling is provided in said chamber and which is adjustably opened when a combustible source of heat is provided in said chamber.

6. The air conditioner of claim 1 including a platform mounted to the exterior of said front wall below said opening and a screen resting on said platform and removable covering said opening whereby said air conditioner is a fireplace.

7. The air conditioner of claim 6 wherein said front wall includes a rim on its exterior adjacent said opening for receiving and retaining said screen.

8. The air conditioner of claim 1 wherein said forced air means includes a fan and a source of water for producing humid forced air.

9. The air conditioner of claim 1 wherein said back and two side walls of said housing and of said interior walls each are made of a single piece of metal welded to said top, said top is planar and extends beyond the points of welding.

10. The air conditioner of claim 1 wherein said housing walls have a thickness of less than the thickness of said interior walls.

11. The air conditioner of claim 1 wherein said bottom of said housing is double walled and includes an opening in the rear portion, vent in the front portion and air directing means interior said bottom's double walls for directing said forced air from the rear opening to said vent.

12. The air conditioner of claim 1 including a bottom interior wall adjacent said bottom wall for forming a bottom forced air channel, a plurality of openings interconnecting the back and two side portions of said U-shaped forced air channel and said bottom forced air channel.

13. The air conditioner of claim 12 wherein said bottom forced air channel includes means interior to said bottom forced air channel for directing forced air from said back portion of said U-shaped forced air channel through said bottom forced air channel to said side portions of said U-shaped forced air channels.

14. The air conditioner of claim 13 including vents in the front portion of said bottom forced air channel and said directing means directed a portion of said forced air towards said vents.

15. The air conditioner of claim 1 including a bottom interior wall adjacent said bottom wall for forming a bottom forced air channel and a vent in the front portion of said bottom forced air channel; and a platform extending from said front wall separating said opening and said vent in said bottom forced air channel.

16. The air conditioner of claim 15 wherein said bottom forced air channel includes means interior said bottom forced air channel for directing forced air over a substantial portion of said bottom wall.

17. An air conditioning unit comprising:

a chamber for holding a source of heat having a top, a bottom, a front, a back and two side walls;

an opening providing access to said chamber;

a back, two side, and bottom exterior walls adjacent respective walls of said chamber forming forced air channels therebetween;

means interior to said air channel for directing air over said back, two side and bottom walls of said chamber;

vent means in a front wall of each of said sides and bottom air channels adjacent said opening;

a rim mounted to said front wall of each of said side air channels and extending across said vent means from the outer lateral edge thereof;

the side walls of said forced air channel forming an angle less than ninety degrees with the front wall of said side air channels; and means for forcibly introducing air into the back portions of said air channel to traverse said back, two side, and bottom walls of said chamber to absorb heat and exit said vent means creating an exiting forced air pattern adjacent the edges of said opening.

18. The air conditioner of claim 17 wherein said air introducing means draws air exterior of the area defined by the forced air exiting said vent means.

19. The air conditioner of claim 17 wherein said chamber includes an opening in said front wall for providing access, and said vent means are adjacent the sides of said access opening to surround substantial portions of said sides and bottom of said access opening with exiting forced air.

* * * * *

UNITED STATES PATENT AND TRADEMARK OFFICE

CERTIFICATE OF CORRECTION

PATENT NO. : 4092976

DATED : June 6, 1978

INVENTOR(S) : Carrol E. Buckner

It is certified that error appears in the above-identified patent and that said Letters Patent are hereby corrected as shown below:

Claim 5, line 1, delete "2" and insert therefore--1--.

Claim 11, line 3, after "vent" insert --means--

Claim 11, line 6, after "vent" insert--means--

Claim 19, line 2, delete "an" and insert therefore--said--

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*